United States Patent [19]

Nakamura et al.

[11] 3,957,211

[45] May 18, 1976

[54] REFUSE DISINTEGRATION DEVICE

[75] Inventors: Minoru Nakamura, Amagasaki; Hisashi Ikegi, Suita, both of Japan

[73] Assignee: Osaka Kiko Co., Ltd., Tokyo, Japan

[22] Filed: Jan. 15, 1975

[21] Appl. No.: 541,217

[30] Foreign Application Priority Data

Jan. 24, 1974 Japan ..... 49-10818

[52] U.S. Cl. ..... 241/73; 241/88.4; 241/190; 241/285 B

[51] Int. Cl.[2] ..... B02C 13/06

[58] Field of Search ..... 241/73, 88.4, 190, 243, 241/285 B

[56] References Cited

UNITED STATES PATENTS

| | | | |
|---|---|---|---|
| 361,000 | 4/1887 | Creager | 241/88.4 |
| 2,137,388 | 11/1938 | Chapman | 241/190 X |
| 3,360,204 | 12/1967 | Merges et al. | 241/73 |
| 3,419,223 | 12/1968 | Morin | 241/285 B X |
| 3,840,187 | 10/1974 | Brewer | 241/243 X |
| 3,874,604 | 4/1975 | Gronberg et al. | 241/243 |

*Primary Examiner*—Granville Y. Custer, Jr.
*Assistant Examiner*—Howard N. Goldberg
*Attorney, Agent, or Firm*—Paul & Paul

[57] ABSTRACT

A refuse disintegration device including a casing having a chamber therein, inlet means communicated with the chamber for introducing refuse which should be disintegrated and at least one rotatable shaft extending through the chamber, which shaft is connected to a drive means which rotates the shaft. A set of spaced apart rotary knives are fixably mounted on the shaft in the chamber, whereas a set of stationary knives are arranged in the chamber so that they extend traversally to the axis of the shaft. Each of the stationary knives is fixably mounted to the casing at both ends thereof. The rotary knives and the stationary knives are alternately arranged to each other so as to thereby effect disintegration of the refuse into chips upon the rotation of the rotary knives.

3 Claims, 5 Drawing Figures

REFUSE DISINTEGRATION DEVICE

DESCRIPTION OF THE INVENTION

The present invention relates a refuse disintegration device adapted for disintegrating refuse of various types (for example, worn out tires of vehicles, used plastic materials, leather and bottles, and broken glass, etc.) into small chips less than a predetermined size, for reuse of the refuse material.

The presently known types of refuse disintegration devices suffer from certain drawbacks, such as the following.

1. In such device it is necessary to rotate the rotary knives at a speed above 1000 r.p.m. for disintegration of the refuse. This is because the disintegration operation in such a device is effected by impact force generated between the rotary knives and stationary knives. As a result of this, operational noise together with vibration occur and the device consumes a large amount of power.

2. The stationary knives are secured to a casing of the device in cantilever fashion and, therefore, the stationary knives on the casing are easily moved by said impact force. Consequently, frequent maintenance is necessary to adjust the gap between the rotary knives and stationary knives so that effective disintegration can take place and, also, to prevent damage to the knives.

3. The service life of both the rotary knives and stationary knives is short because of the impact force applied to the knives during the disintegrating operation.

An object of the present invention is to provide a refuse disintegration device which obviates the above mentioned drawbacks, in spite of having a simple and durable design.

The above object is achieved by a refuse disintegration device, according to the invention, which comprises:

a casing having a chamber therein;

inlet means communicated with said chamber for introducing refuse which should be disintegrated;

at least one rotatable shaft extending through said chamber, said shaft being connected to drive means to rotate said shaft;

a set of spaced apart rotary knives fixably mounted on said shaft in said chamber;

a set of stationary knives arranged in said chamber while extending traversely to the axis of said shaft, each said stationary knife being fixably mounted to said casing at both ends thereof, said rotary knives and said stationary knives being alternately arranged to each other, thereby effecting the disintegration of said refuse into small chips upon the rotation of said rotary knives.

Other objects and advantages of the present invention will become apparent from the ensuing description and the accompanying drawings which illustrate both a known refuse disintegration device and, by way of example, an embodiment of the refuse disintegration device according to the present invention.

FIG. 4-*a* is a perspective view of a part of the device, illustrating an arrangement of rotary knives;

FIG. 4-*b* is a view similar to FIG. 4-*a*, but illustrating another arrangement of the rotary knives.

Figure 1:
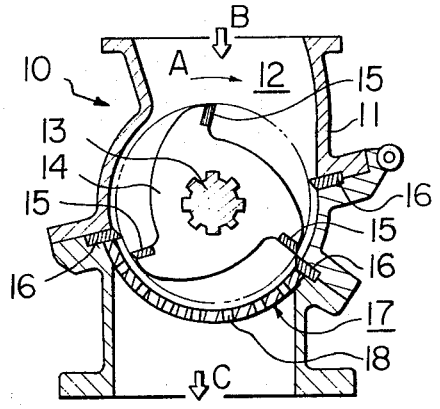
Fig. 1 PRIOR ART
FIG. 1 is a sectional view of a known refuse disintegration device.
Figure 1:
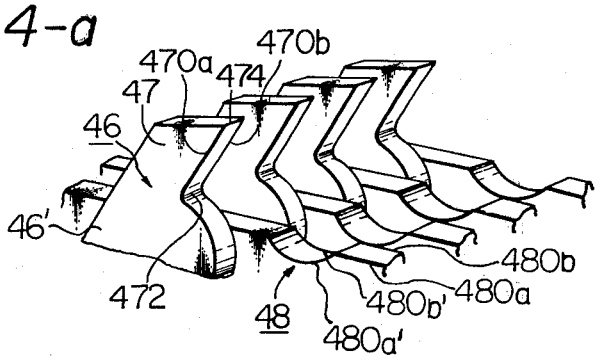
Fig. 1 PRIOR ART
Figure 1:
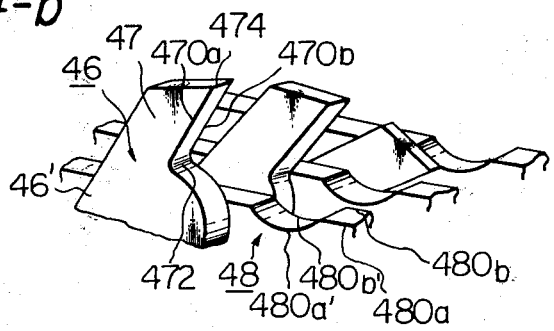
Fig. 1 PRIOR ART

In FIG. 1, numeral 10 shows a refuse disintegration device of a known type. The device 10 comprise a casing 11 having a chamber 12 therein. A shaft 13 extending horizontally through the chamber 12 is supported by the casing 11 and is connected to a drive motor (not shown). In the chamber 12, a set of rotary knives 14 (only one of which is shown) is fixed to the shaft 13 by spline engagement. Each rotary knife 14 has a plurality of cutting tips 15 which extend radially. Sets of stationary knives 16 (only one set is shown) are provided on the casing 11, each knife set corresponding to the each rotary knife 14. Each stationary knife 16 is secured to the casing 11 in cantilever fashion. A curved filtering plate 17 having a plurality of holes 18 is arranged underneath the rotary knives 14.

When rotary knives 14 are rotated in the direction shown by arrow A in FIG. 1, refuse which is supplied into the chamber 12 in the direction shown by arrow B in FIG. 1 is disintegrated into small chips by the impact force generated between the rotating tips 15 of each rotary knife 14 and each stationary knife 16. The chips of the thus cut and disintegrated refuse, the size of which chips is smaller than a predetermined value, pass through holes 18 of the plate 17 and are removed to subsequent processes in the direction shown by arrow C for reuse of the chips.

In this device, the rotary knives 14 must be rotated at a speed above 1000 r.p.m. for effective disintegration of the refuse. This is because the disintegrating operation of the device 10 is effected by the impact force generated between the rotating tips 15 of each rotary knife 14 and each stationary knife 16. This causes operational noise together with vibration of the device 10, as well as large power consumption. Further, in this device, the stationary knives 16 are secured to the casing 11 in cantilever fashion and, therefore, the stationary knives 16 are easily moved by said impact force. As a result of this, frequent maintenance is necessary to adjust the gap between the tip 15 of each rotary knife 14 and each stationary knife 16 in order to achieve effective disintegration. Furthermore, the service life of the knives 14 and 16 are short because said impact force is applied to the knives during the disintegrating operation.

The inventor of the present invention came to the following conclusions with regard to overcoming the above mentioned drawbacks encountered with the known refuse disintegration device. That is, if the refuse is cut and disintegrated into small chips by employing a shearing force generated between rotary knives and stationary knives, the generation of the above-mentioned impact force at the moment of disintegration of the refuse will be avoided and, thus, occurrence of the operating noise together with large power consumption of the disintegrating device will be prevented. Further, that if the stationary knives are secured at both ends, instead of in cantilever fashion, easy movement of the stationary knives during disintegrating operation will be avoided, and, thus, the necessity for troublesome maintenance, required because of the easy movement of the knives, will be obviated.

Figure 2:
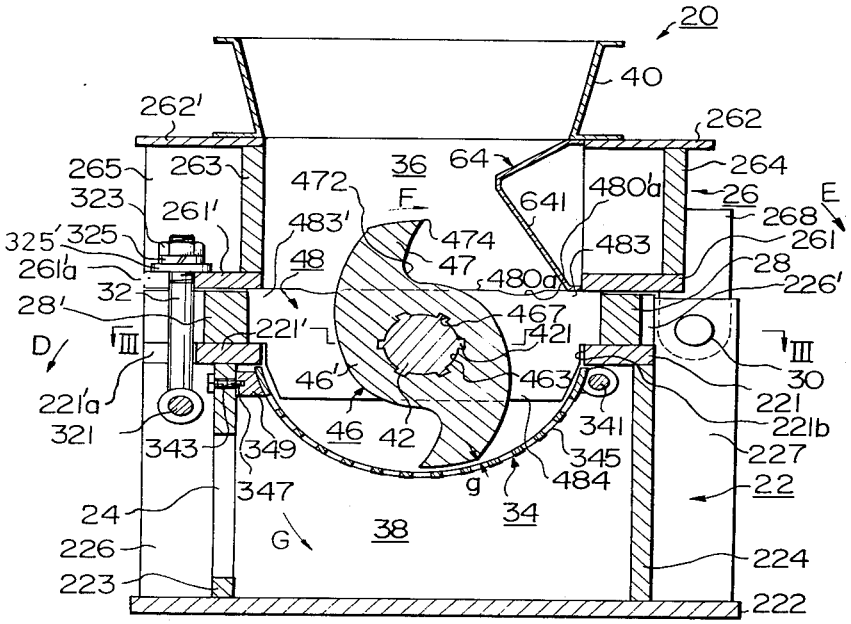
FIG. 2 is a side sectional view of a refuse disintegration device according to the invention taken along II—II line of FIG. 3.
Figure 3:
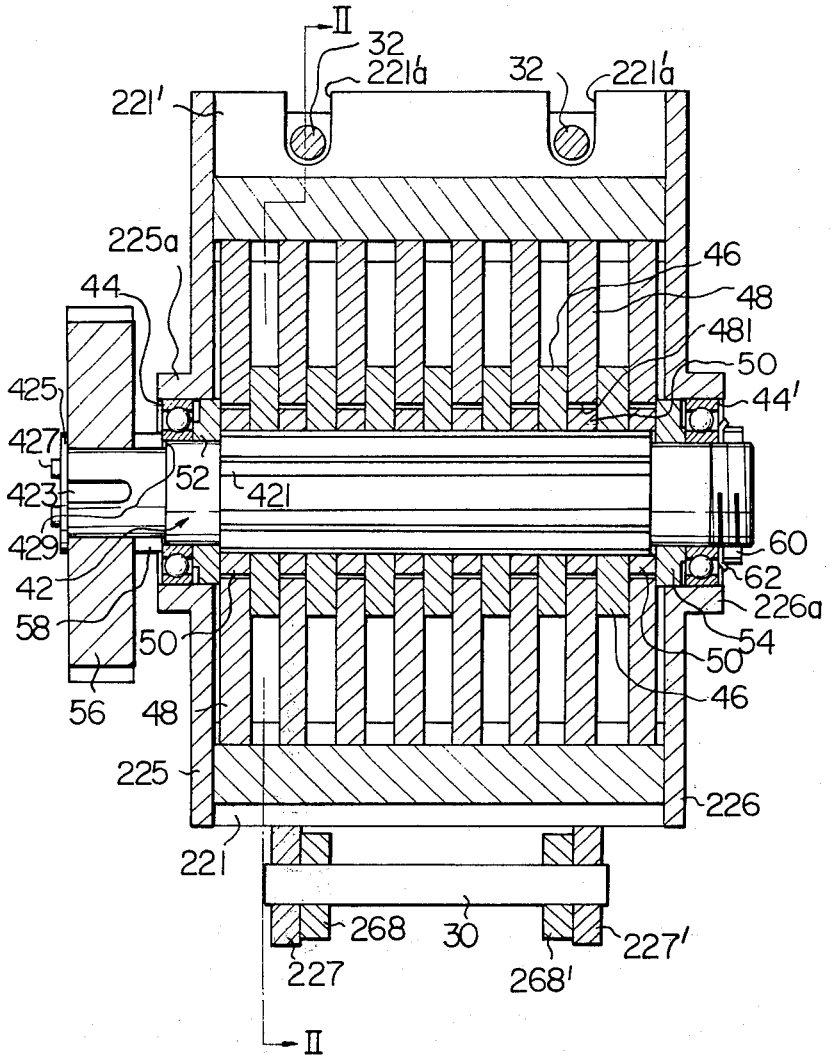
FIG. 3 is a sectional view taken along the III—III line of FIG. 2.

Referring to FIGS. 2 through 4, numeral 20 generally indicates a casing of a refuse disintegration device according to the invention. The casing 20 includes a lower half part 22 formed by welding horizontary parallel two top wall 221 and 221', a bottom wall 222, a front wall 223, a rear wall 224, and side walls 225 and 226. The side walls 225 and 226 have upper extensions. Only the extention 226' of the side wall 226 is shown. An outlet window 24, from which disintegrated refuse chips are removed and through which the interior of the devise can be viewed, is defined in the front wall 223 of the lower casing 22. The casing 20 also includes an upper half part 26 formed by welding horizontally parallel two bottom walls 261 and 261', top walls 262 and 262', a front wall 263, a rear wall 264, and side walls 265 (one of which is shown). Two horizontally parallel cross members 28 and 28' are secured to the top walls 221 and 221', of the lower casing 12, respectively. Vertically elongated plates 268 and 268' are fixed to the rear wall 264 of the upper casing 26 by welding or other suitable means. Vertically elongated plates 227 and 227' are fixed to the rear wall 224 of the lower casing 22. The bottom end of the plates 268 and 268' are pivoted to the top ends of the plates 227 and 227' through a pin 30, so that the upper casing 26 is hinged to the lower casing 22. Clamping bolts 32 adapted for clamping the upper casing 26 to the lower casing 22, pass through U-shaped slots 221'a defined in the top wall 221' of the lower casing 22 and similar U-shaped slots 261'a defined in the bottom wall 261' of the upper casing 26. Each bottom end of the clamping bolts 32 is pivoted to the lower casing 22 by a pin 321. Each top end of the clamping bolt 32 protrudes through the U-shaped hole 261'*a*, and is provided with a nut 323. Therefore, if the nuts 323 are tightened together with the washers 325 and 325', which rest on the wall 261', the upper casing 26 is clamped to the lower casing 22. On the other hand, if the nuts 323 are loosened and the clamp bolts 32 are turned in the counter clockwise direction, as shown by arrow D in FIG. 2, the upper casing 26 can be rotated about the pin 30 in the clockwise direction as shown in arrow E in FIG. 2.

Underneath a rectangular opening 221*b* defined by the top walls 221 and 221', a filter member is provided comprising a platelike member 34 having a round curvature. One horizontal side of the member 34 is hinged to the lower casing 22 through a pin 341 extending axially. The other side of the plate 34 is disengageably connected to the front wall 223 of the lower casing 22 by screws 343 as explained hereinafter. A plurality of filter holes 345 are defined in the plate 34 along the whole width and length of the plate 34.

In the casing 20 an upper chamber 36 is provided for disintegration of supplied refuse. The disintegration chamber 36 is defined by the top walls 262 and 262', bottom walls 221 and 221', the side walls 265, the front wall 263, the rear wall 264, the cross members 28 and 28' the upper extension of side wall 225 and the upper extension 226' of the side walls 226, and the filter plate 34. In the casing 20 there is also provided a lower chamber 38 adapted for storage of disintegrated refuse chips. The lower chamber 38 is defined by the side walls 225 and 226, the front wall 223, the rear wall 224, and the bottom wall 222. The upper chamber 36 communicates with a chute 40 which is secured to the top walls 262 and 262' of the casing 26, and which is adapted for supplying refuse which should be disintegrated to the disintegration chamber 36. The chamber 36 communicates with the lower chamber 38 through the holes 345 of the filter plate 34. The chamber 38 communicates with the outlet window 24 which is adapted for removal of disintegrated chips. A shaft 42 extending horizontally through the disintegration chamber 36 is rotatably mounted in the both portions 225 *a* and 226*a* formed on the side walls 225 and 226 of the lower casing 22. The shaft 42 is supported by ball bearing assemblies 44 and 44' received in the both portions 225*a* and 226*b*. It should be noted that other arrangements for supporting shaft 42 with respect to the casing 20 may be employed. However, it is necessary that these arrangements allow the shaft 42 to be rotated at a speed of about 100 r.p.m.

On the intermediate portion of the shaft 42, there is provided six equi-angularly spaced teeth 421 which extend axially along the shaft 42. A set of spaced rotary knives 46 are mounted to the intermediate portion of shaft 42. Each rotary knife 46 includes a main body 46' having a central bore 463 and projections 47 protruding from the periphery of the main body 46'. In the illustrated embodiment the projections 47 are disposed so as to be diametrically opposed to one another. More than two projections 47, of course, may be used. In the inner surface of the central bore 463 of the rotary knife 46, there is formed six equi-angularly spaced grooves 467. The teeth 421 of the shaft 42 engage with the respective grooves 467 of the central bore 463, so that the rotary knife 46 is axially slidably mounted to the shaft 42, but is prevented from rotation with respect to the shaft 42, and so that six different angular position of the projection 47 will be possible. Other arrangements for allowing axially slidable engagement of the rotary knife 46 to the shaft 42 while preventing rotation of the rotary knife 46 with respect to the shaft 42 are possible. For example, the shaft 42 may be of a hexagonal shape in section, and the bore 463 may also be hexagonal in shape, so that the hexagonal shaft may be slidably fitted into the hexagonal bore while rotational motion is prevented.

Each projection 47 of the rotary knife 46 has two opposite flat planes which are parallel with each other in the direction of the rotating axis of the rotary knives 46. The planes define a pair of front cutting edges 470*a* and 470*b* inclined toward the direction of rotation (shown by arrow F in FIG. 2) of the rotary knive 46.

In the disintegration chamber 36 there is provided a set of stationary knives 48, each forming a plate like member. Each knife 48 has a central bore 481 permitting the introduction of the stationary knife 48 into the shaft 42. Each plate like knife 48 has two opposite flat planes which are parallel with each other in the direction of the rotating axis of the rotary knives. The opposite planes define a pair of transversely extending upper edges 480*a* and 480*b*. In the preferred embodiment of the invention each of the upper edges 480*a* and 480*b*, has a curved portion 480*a'* and 480*b'*, the reason for which will be described hereinafter.

The rotary knives 46 and stationary knives 48 are alternately so arranged that each rotary knife 46 is interposed, between two adjacent stationary knives 48 and the two flat planes of each said rotary knife 46, contact with the facing flat planes of said adjacent stationary knives 48.

The end portions 483 and 483' of each stationary knife 48 are clamped between the lower surface of the bottom walls 261 and 261' of the upper casing 26 and upper surface of the top walls 221 and 221' of the lower casing 22. The cross members 28 and 28' secured to walls 221 and 221' serve to align each stationary knife 48 transversely to the shaft 42 and parallel with each other. A bottom part 484 of each stationary knife 48 extends through the opening 221*b* of the lower casing 22.

In a preferred embodiment of the invention, a set of spaced annular spacers 50 are fitted to the intermediate portion of the shaft 42 to provide a constant axial space between two adjacent rotary knives 46. Each spacer 50 is arranged in the respective central bore 481 of the stationary knife 48.

At one end of the shaft 42, ring members 52 are mounted between the ball bearing assembly 44 and the left most (in FIG. 3) stationary knife 48 and spacer 50. The ring member 52 is axially slidable on the shaft 42, although the axial slide at the right hand in FIG. 3 is restricted by the teeth 421 of the shaft 42. A similar ring member 54 is mounted between the ball bearing assembly 44' and right most (in FIG. 3) rotary knife 46 and spacer 50. The axial slide of the ring member 54 in left hand direction is restricted by the tooth 421 of the shaft 42.

A gear 56 is secured to one end of the shaft 42 by a key (not shown), a groove 423 defined on the shaft, 42, circular plate 425 and bolts 427 screwed to the butt surface of the shaft 42. A ring spacer 58 is fitted to the shaft 42 between the gear 56 and shoulder 429 formed on the shaft 42 at one end thereof. The ring member 52 also serves as a stop means for the inner race of the bearing assembly 44. A nut 60, adapted for fixing the rotary knives 46 to the shaft 42, is screwed to the other end of the shaft 42 through the washer 62 abutting the inner race of the bearing assembly 44'. Therefore, the adjustment of axial thrust force acting between the facing planes of an adjacent stationary knife 48 and rotary knife 46 is provided by screwing and unscrewing the nut 60. As a result of this, each rotary knife 46 is rotated under an adjusted force provided between said facing planes.

As already illustrated, each rotary knife projection 47 has cutting edges 470*a* and 470*b* inclined toward the direction of rotation thereof, so that a curved portion 472 is formed at the base of the projection 47. Therefore, refuse which should be disintegrated is easily caught by the edges 470*a* and 470*b* of the rotary knife projection 47 and the upper edges 480*a* and 480*b* of the stationary knife 48 in response to the rotation of the knife 46. In one arrangement of the invention, all the knife projections 47 are so arranged that the tips 474 of the projections 47 are aligned with a line parallel to the axis of the shaft 42 as shown in FIG. 4-*a*. However, it is more preferable that, the tips 474 of the knife projections 47 are out of registry with each other, as shown in FIG. 4-*b*, in the direction of rotation of the knife 46 at a predetermined regular angle. This latter arrangement is made possible by the fact that the rotary knives have the central bore 463 provided with equi-angularly spaced grooves 467 which are engaged with equi-angularly spaced teeth 421 of the spline shaft 42.

A plate member 64 which has a section such as shown in FIG. 2, is arranged below the chute 40 and above the knives 46 and 48. The plate 64 has a portion 641 which is inclined inwardly and which cooperates with the projections 47 of the rotary knives 46 so as to promote the catching of refuse which is fed from the chute 40.

The filter plate 34 having a round curvature, is so arranged that a slight constant gap "*g*" is maintained between the tips 474 of the projections 47 and the upper surface of the plate 34 when knives 46 rotate. The front axial side of the plate 34 is secured to the front wall 223 by bolts 343, which are screwed into the front wall 223 and have an end portion 347 which inserted into a respective hole defined in a piece 349 secured to the front side of the filter plate 34. Therefore the filter plate 34 is disengageable, in the direction shown by arrow G in FIG. 2, when removing the bolts 343.

The gear 56 is connected to suitable driving means (not shown) through gears (not shown) meshing with the gear 56 and an electric motor (not shown) to rotate the shaft 42, in other words rotatary knives 46, in the direction shown by arrow F in FIG. 2. It should be appreciated that the gear 40 is replaced by a pulley or sprocket wheel which is connected to the motor through a belt or chain.

The operation of herein described refuse disintegration device according to the invention is as follows.

When supplying refuse which should be disintegrated from the chute 40, the refuse is, first, held between the rotary knife projections 47, rotating in the direction shown by the arrow F, and the inwardly inclined portion 641 of the plate 64. Then, the refuse is caught between the edges 470*a* and 470*b* of the knife projections 47 and upper edges 480*a* and 480*b* of the stationary knives 48. This catching operation of the refuse will be promoted by the fact that the upper edges 480*a* and 480*b* of the stationary knife 48 have the curved portions 480*a'* and 480*b* '. The thus caught refuse is cut and disintegrated by searing force generated between facing and contacting planes of adjacent rotary knife 46 and stationary knife 48. The contact force between said facing planes is adjusted by screwing or unscrewing the nut 60. If the refuse is brittle material, such as glass bottles, the contact force should be decreased. Whereas, if the refuse is sticky material, such as plastic film, said contact force should be increased.

When the each rotary knife is arranged as shown in FIG. 4-*b*, said shearing force is decreased and is equalized during the rotation of the rotary knife 46, so that the power consumption of the device can be decreased. Therefore, this arrangement is preferable.

The cut and disintegrated refuse chips fall downward between the stationary knives 48 to the upper surface of the filter plate 34. The disintegrated refuse chips which are smaller than the holes 345 of the filter plate 34, pass through the holes 345 and fall into the chamber 38, and are stored in the chamber 38. The refuse chips which are larger than the hole 34 are moved upwardly by the rotating knife projections 47, and are again cut and disintegrated as hereinbefore described. When a predetermined amount of disintegrated refuse chips is stored in the chamber 38, the chips are removed from the window 24 of the front wall 223 of the lower casing 22 to a subsequent process.

If the filter holes 345 of the plate 34 are clogged because of prolonged disintegrating operations or for other reasons, the bolts 343 are unscrewed in order to pivot the plate 34 about the pin 341 in the direction shown by arrow G in FIG. 2. This allows cleaning of the clogged holes 345 by suitable means, which should be inserted through the window 24 of the lower casing 22.

If the right-hand portions of the upper edges 480*a* and 480*b* of the stationary knife 48 are worn out during prolonged cutting operations, the left-hand portions of the upper edges 480*a* and 480*b* may be used by reversing the left and right-hand portions of the upper edges of the knife 48.

It should be noted that operational noise and power consumption of the device according to the present invention is minimized. This is because the refuse which should be disintegrated is cut by shearing force instead of impact force, the shearing force being generated between facing planes of an adjacent stationary knife 48 and rotary knife 46, so that an effective cutting operation is attained even if the rotational speed of the rotary knives 46 is as low as 100 r.p.m.

It should be also noted that the stationary knives 48 are clamped and fixed between the upper casing 26 and lower casing 22 at both end portions 483 and 483' of the knives 48. Therefore, the stationary knives 48 are not easily moved during the disintegration operation and, as a result, prolonged service life of the knives 48 is attained.

In the device, the contacting force generated between the facing planes of an adjacent rotary knife 46 and stationary knife 48 is maintained at a predetermined value over a long period of operation without readjustment. Thus, frequent adjustment of the value of this contacting force is avoided.

The size of the disintegrated chips obtained by the device according to the invention can be adjusted by changing the size of the holes 345 of the filter plate 34. Therefore, the chips may be directly used in a subsequent process. For example, if worn out tires are disintegrated by the device of the present invention, the disintegrated tire chips can be directly reused for the manufacture of new tires, and if the device is used for plastic material, the disintegrated plastic chips may be directly used in an extruding machine without first going through a pelletizing machine.

While the invention has been described by reference to a specific embodiment, it should be apparent that numerous modifications may be made within the spirit and scope of the invention.

What we claim is:

1. A refuse disintegration device comprising, a casing having a chamber therein, inlet means communicated with said chamber for introducing refuse which should be disintegrated, at least one rotatable shaft extending through said chamber, said shaft being connected to drive means to rotate said shaft, a set of spaced apart rotary knives fixably mounted on said shaft in said chamber, a set of stationary knives arranged in said chamber being fixably mounted to said casing at both ends thereof, said rotary knives and said stationary knives being alternately arranged to each other;

the improvement wherein each said rotary knife comprises a main body and at least one projection having two opposite flat planes which are parallel to each other in the direction of the axis of said rotary knives, each said plane defining a front cutting edge inclining toward the direction of rotation of each said rotary knife, whereas each said stationary knife comprises a plate like member having two opposite flat planes which are parallel to each other in the direction of the axis of said rotary knives, each said plane defining upper edge cooperable with one of said edges of each said projection, said stationary knives having a bore therethrough, through which said shaft passes; each rotary knife being rotatable between two adjacent stationary knives, the two flat planes of each said rotary knife projection being also in contact with the facing flat planes of said adjacent stationary knives.

2. A refuse disintegration device according to claim 1, wherein tips of the projections of said rotary knives are out of registry with each other.

3. A refuse disintegration device according to the claim 1, in which there is provided means which allow an axial slidable engagement between each said rotary knife and each said shaft but prevent rotating motion of each said knife with respect to said shaft, and in which each said stationary knife has a central bore through which said shaft passes, wherein means for effecting the adjustment of axial thrust force acting between facing planes of each adjacent stationary knife and projection of the rotary knife is provided on both ends of said shaft, so that each said rotary knife is rotated under an adjusted contact force provided between said facing planes.

* * * * *